US007988256B2

(12) United States Patent
Burmeister et al.

(10) Patent No.: US 7,988,256 B2
(45) Date of Patent: Aug. 2, 2011

(54) WEB

(75) Inventors: Tanya W. Burmeister, Vancouver, WA (US); Antonio Gomez, Vancouver, WA (US); Mark D. Groenenboom, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 539 days.

(21) Appl. No.: 12/200,927

(22) Filed: Aug. 28, 2008

(65) Prior Publication Data

US 2010/0053260 A1 Mar. 4, 2010

(51) Int. Cl.
*B41J 2/165* (2006.01)

(52) U.S. Cl. ..... 347/33; 347/22

(58) Field of Classification Search ..... 347/22, 347/33

See application file for complete search history.

(56) References Cited

U.S. PATENT DOCUMENTS

| | | | | |
|---|---|---|---|---|
| 6,189,998 | B1 | 2/2001 | Yanagi et al. | |
| 6,474,774 | B1 | 11/2002 | Okamoto | |
| 6,520,621 | B1 | 2/2003 | Eckard et al. | |
| 6,561,619 | B1 | 5/2003 | Shibata et al. | |
| 6,692,100 | B2 * | 2/2004 | Steinfield et al. | 347/22 |
| 7,246,556 | B1 | 7/2007 | Stoneberg et al. | |
| 7,316,466 | B2 | 1/2008 | Uwagaki et al. | |
| 7,562,961 | B2 * | 7/2009 | Inoue | 347/35 |
| 2004/0080563 | A1 | 4/2004 | Leemhuis | |
| 2006/0266239 | A1 | 11/2006 | Yip | |
| 2007/0046724 | A1 | 3/2007 | Jung et al. | |
| 2007/0242121 | A1 | 10/2007 | Kersey et al. | |
| 2008/0024550 | A1 | 1/2008 | Miyazawa | |

FOREIGN PATENT DOCUMENTS

| | | |
|---|---|---|
| JP | 404131249 | 5/1992 |
| JP | 406071904 | 3/1994 |

* cited by examiner

*Primary Examiner* — Julian D Huffman
*Assistant Examiner* — Jason S Uhlenhake

(57) ABSTRACT

A web has a surface layer integrally extending between opposite transverse edges. The surface layer includes absorbent region separated by at least one nonabsorbent region.

16 Claims, 5 Drawing Sheets

WEB

BACKGROUND

Webs are sometimes used to service print heads in a printing system. Continual replacement of such webs may be tedious, time-consuming and expensive.

DETAILED DESCRIPTION OF THE EXAMPLE EMBODIMENTS

Figure 1:
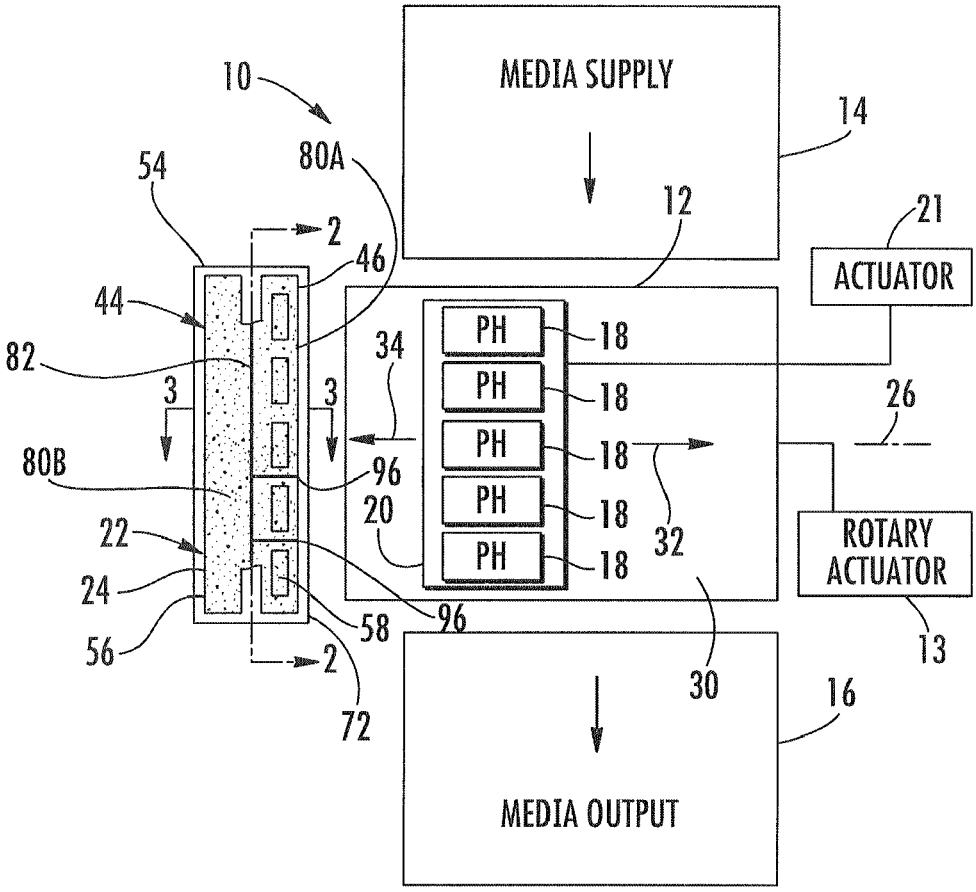
FIG. 1 is a schematic illustration of a printing system according to an example embodiment.
Figure 2:
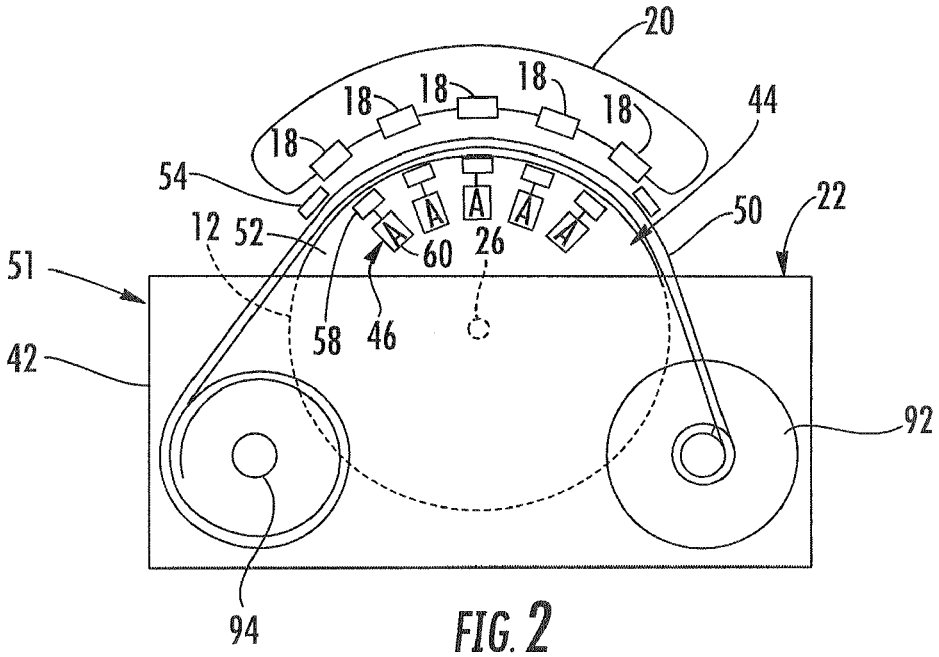
FIG. 2 is a sectional view of the printing system of FIG. 1 taken along line 2-2 according to example embodiment.

FIGS. 1 and 2 schematically illustrate printing system 10 according to one exemplary embodiment. Printing system 10 generally includes drum 12, rotary actuator 13, media supply 14, media output 16, print heads 18, carriage 20, actuator 21 and service station 22. Drum 12 generally comprises an elongated cylinder configured to be rotationally driven about axis 26 by rotary actuator 13 while transporting media, such as paper, about axis 26 relative to print heads 18. Rotary actuator 13 comprises a source of torque, such as a motor, operably coupled to drum 12 by a transmission (not shown).

Media supply 14, schematically shown, comprises a mechanism configured to supply media to drum 12. In one embodiment, media supply 14 comprises a mechanism configured to pick an individual sheet of media from a stack of media and to supply the individual sheet to drum 12 such that the sheet is wrapped at least partially about drum 12. Media output 16, schematically shown, comprises a mechanism to withdraw printed upon media from drum 12 and to transport withdrawn media to and contain withdrawn media within an output tray, bin or the like.

Print heads 18 comprise print heads configured to dispense imaging material, such as ink, upon the medium held by drum 12. In one embodiment, print heads 18 comprise piezo electric print heads. In another embodiment, print heads 18 comprise thermal inkjet print heads. As shown by FIG. 2, print heads 18 are arranged in an arc about axis 26. As a result, print heads 18 are configured to print across a larger area of the media supported by drum 12. In the particular embodiment, drum 12 has an outer surface 30 also arranged in an arc about axis 26. Print heads 18 are arranged in an arc substantially identical to the arc in which surface 30 extends.

Carriage 20 comprises one or more structures configured to support print heads 18 in the arcuate arrangement. In addition, carriage 20 is configured to movably support print heads 18 along axis 26. Actuator 21 comprises a linear actuator configured to move carriage 20 and print heads 18 in the directions indicated by arrows 32, 34 so as to selectively position print heads 18 opposite to the media held by drum 12 or opposite to service station 22. In one embodiment, actuator 21 may comprise a motor configured to drive a toothed pulley in engagement with a toothed belt coupled to carriage 20. In another embodiment, actuator 21 may comprise other forms of a linear actuator using rack and pinion arrangements, hydraulic, pneumatic or electrical means. Although system 10 is illustrated as including five print heads supported by a single carriage 20, system 10 may alternatively include a greater or fewer number of such print heads 18 supported by one or more carriages 20. For example, in another embodiment, a separate carriage 20 may be provided for each print head 18.

Service station 22 comprises a station located on an axial end of drum 12 such that carriage 20 may position print heads 18 opposite, or adjacent, to station 22. Station 22 includes one or more components configured to perform servicing operations upon one or more of the print heads 18. As shown by FIG. 2, in the particular example shown, service station 22 further includes a housing 42, track 44, lifters 46 and web 50. Housing 42 comprises one or more walls, panels, structures and the like configured to support track 44 and web 38 relative to drum 12. As shown by FIG. 1, housing 42 supports track 44 and web 50 form a single individual unit or cartridge 51 that is configured to be removed from drum 12. In one embodiment, cartridge 51 is configured to be inserted adjacent to or removed from drum 12 by movement substantially perpendicular to axis 26 as indicated by arrows 52. In another embodiment, cartridge 51 is configured to be inserted adjacent to or removed from drum 12 in a direction substantially parallel to axis 26 as indicated by arrow 54. The removability of cartridge 51 facilitates replacement, repair, refurbishment, or refilling of cartridge 51. For example, when web 50 becomes sufficiently saturated with printing material or ink from print heads 18, cartridge 51 may be removed and either replaced with an entirely new cartridge or be refilled with another web 50. Alternatively, if cartridge 51 has become damaged, cartridge 51 may be replaced. As a result, the useful life of printing system 10 is not limited by the useful life of web 50. In other embodiments, housing 42 may alternatively be fixed relative to drum 12 so as to not be removable and reinsertable as a cartridge 51.

As shown by FIG. 2, track 44, schematically shown, comprises one or more structures configured to support web 50 in an arc about axis 26. In the particular example shown, track 44 is configured to support web 50 about an arc substantially similar to the arc along which print heads 18 are arranged. In one embodiment, track 44 comprises an elongate arcuate panel or surface underlying web 50. In yet another embodiment, track 44 comprises multiple individual surfaces that are spaced from one another in an arc. For example, in one embodiment, track 44 may be formed from multiple rollers extending in the arc.

In particular example illustrated, track 44 includes a bottom support 52 and a top cover or panel 54. Bottom support 52 extends below web 50 while top panel 54 extends over web 50 so as to sandwich and contain web 50. Top panel 54 includes windows 56 which expose portions of web 50. In other embodiment, top panel 54 may be omitted. Because track 44 supports web 50 in an arc, web 50 may be used to simultaneously service multiple print heads 18.

Lifters 46 comprise mechanisms configured to lift or elevate selected portions of web 50 and to press or hold such elevated portions of web 50 against opposite portions of print heads 18 to facilitate wiping of print heads 18. In the example illustrated, each of lifters 46 includes a web backer 58 and an actuator 60. Web backer 58 comprises a structure configured to move between (1) a raised position in which web backer 58 contacts and underside of web 50 and lifts the opposing portion of web 50 to a height sufficient to contact and associated opposing print head 18 and (2) a lower position in which web 50 is spaced from print heads 18. In one embodiment, in a raised position, web backer 58 supports web 50 above track 44 and in the lowered position allows web 50 to rest upon bottom support 52 of track 44.

Actuator 60 comprises a mechanism configured to selectively move web backer 58 between the raised and lowered positions. In one embodiment, actuator 60 may comprise one or more cams driven by a motor or other powers source. In another embodiment, actuator 54 may comprise electric solenoids, pneumatic or hydraulic cylinder assemblies or other actuation mechanisms which directly interact with web backer 58 or which drive an intermediate cam which facilitates movement of web backer 58. In other embodiments where other mechanisms are provided for wiping of print heads 18 and where web 50 is merely used to receive fluid ejected from print heads 18, such as during spitting or purging operations, lifters 46 may be omitted.

Web 50 comprises a band or span of material for performing servicing operations upon print heads 18. In one embodiment, web is configured to interact with print heads 18 by receiving fluid, printing material or ink discharged from print heads 18. For example, in one embodiment, print heads 18 include multiple nozzles. Web 50 facilitates spitting of ink from the nozzles to clear such nozzles. In the embodiment illustrated, web 50 comprises a web of material configured to physically contact the surfaces of print heads 18 so as to wipe print heads 18. In the particular example illustrated, web 50 is also configured to contact the surfaces of print heads 18 as carriage 20 moves print heads 18 along axis 26 relative to web 50 to wipe print heads 18. In other embodiments, web 50 may additionally be configured to be moved relative to print heads 18 to perform such wiping operations. In one embodiment, web 50 comprises a web of fluid absorbent material. In one embodiment, web 50 comprises a fabric material. According to one embodiment, web 50 is formed from a fabric material such as Evolon 100 commercially available from Freudenberg Group of Germany.

Figure 3:
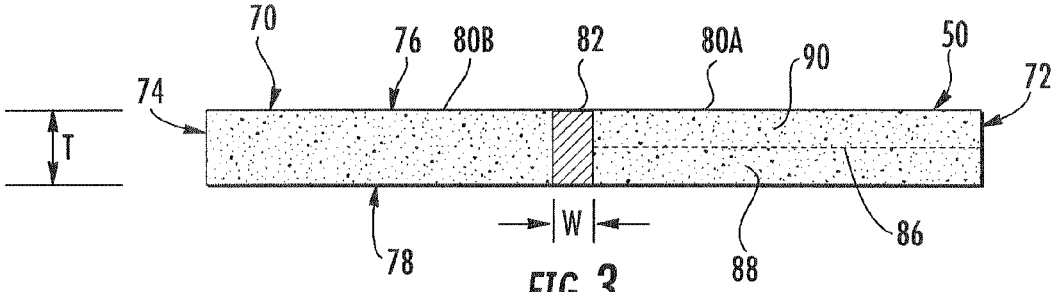
FIG. 3 is a sectional view of the printing system of FIG. 1 taken along line 3-3 according to an example embodiment.

As shown by FIGS. 1 and 3, web 50 is supported by track 44 over lifters 46 in an arc. As shown by FIG. 1, web 50 is exposed through windows 56. A portion of web 50 overlays lifters 46 so that web 50 may be raised into contact with print heads 18 during servicing of print heads 18.

FIG. 3 illustrates web 50 in more detail. As shown by FIG. 3, web 50 is formed from one or more layers, wherein at least a top layer of web 50 is integrally formed as a single unitary body. Because web 50 has a top layer which is integrally formed as a single unitary body, web 50 is less likely to separate when placed in tension.

In a particular example illustrated, web 50 is formed from a single layer of material integrally formed as a single unitary body. Web 50 comprises a single surface layer 70 which is integrally formed as a single unitary body and which integrally extends between opposite transverse edges 72 and 74. Because web 50 is formed from a single layer which is integral from side edge 72 to side edge 74 and which is also integral from a top surface 76 to a bottom surface 78, web 50 avoids delamination issues between multiple layers. Consequently, web 50 has greater integrity.

In addition, because web 50 is formed from a single layer 70, web 50 may have a reduced thickness while still having sufficient absorption capabilities. Because web 50 has a reduced thickness, a roll may be provided with a greater number of windings of web 50 occupying the same volume or space. As a result, a larger number of servicing operations may be performed with web 50 without consumption and replacement of web 50. In other embodiments, web 50 may alternatively include multiple layers, wherein the topmost layer is integrally formed as a single unitary body and extends from side edge 72 to side edge 74.

As further shown by FIG. 3, layer 70 includes absorbent regions 80A and 80B (collectively referred to as absorbent regions 80) separated or fluidly insulated or isolated from one another by nonabsorbent region 82. Absorbent regions 80 comprise portions of layer 70 which are configured to absorb fluid or, alternatively, wick fluid away from top surface 76. In one embodiment, absorbent regions 80 comprise one or more fabric materials configured to absorb or retain fluid, such as ink. In another embodiment, absorbent regions 80 comprise one or more porous or capillary materials configured to absorb or retain fluid. In the example illustrated, regions 80 are formed from substantially identical homogenous mixtures of fabric, fibers or other absorbent material such that regions 80 at substantially similar absorbent properties. In such an embodiment, fabrication of web 50 is simplified.

In other embodiments, although still integral with one another, regions 80A and 80B may alternatively have different blends of fibers or fabric materials providing regions 80 with different absorption properties. For example, in one embodiment, one of regions 80 may be located to perform a first servicing operation while other of regions 80 are configured to perform another distinct servicing operation upon print heads 18. In such an embodiment, regions may of different blends or compositions. In one embodiment, one of regions 80 may have a blend or composition ideally suited for wiping print heads 18, such as being softer, while the other of regions 80 may have a blend or composition ideally suited for overall fluid absorption and retention, more suitable for retaining fluid purged or spit from print heads 18.

In still other embodiments, one or both of regions 80, while still being integral, may have different compositions or different densities between surfaces 76 and 78. In some embodiments, portions of layer 70 proximate to surface 78 may have a different density or composition as compared to portions of layer 70 proximate to surface 76. For example, as indicated by the broken line 86, in some embodiments, a lower portion 88 of layer 70 may have a greater density or a different blend of fabric or fibers as compared to an upper portion 90 of layer 70. In one embodiment, portion 88 may have a greater density, increasing its fluid containing capacity as compared to upper portion 90. In such an embodiment, this may facilitate wicking of fluid away from surface 76 and retention of such fluid away from surface 76. In another embodiment, layer 70 may be provided with a gradually changing blend or composition or additional different portions between surfaces 76 and 78. In other embodiments, regions 80 of layer 70 may be homogenous from surface 76 to surface 78.

Nonabsorbent region 82 extends between absorbent regions 80. Nonabsorbent region 82 forms a wall substantially impervious to fluid flow or fluid migration. As a result, nonabsorbent region 82 inhibits or even prevents fluid migration from one region 80 to another region 80. In the example illustrated, nonabsorbent region 82 extends substantially from top surface 76 to bottom surface 78 of layer 70 to inhibit any migration of fluid from any portion of region 80A to any portion of region 80B and vice versa. In another embodiment, nonabsorbent region 82 may alternatively extend from top surface 76 to a depth sufficiently close to bottom portion 78 such that migration is inhibited or prevented or such that any fluid that does migrate from one region 80 to another region 80 remains retained or contained within the migrated to region proximate to surface 78 without migrating to surface 76.

Nonabsorbent region 82 is integral with absorbent regions 80. For purposes of this disclosure, when used to describe a nonabsorbent region's relationship with adjacent absorbent regions, the term "integral" shall mean that the nonabsorbent region is not formed or does not exist as a result of the nonabsorbent region being joined or connected to an absorbent regions, such as by gluing, welding, stitching, fastening or the like. Instead, when used to describe a nonabsorbent region's relationship with adjacent absorbent regions, the term "integral" shall mean that nonabsorbent region 82 exists or is formed by a change in state of one or more materials that already exist to form absorbent regions 80 of layer 70 or is formed by the addition of one or more materials that blends in or coexists in the same space as the already existing materials that form the absorbent regions of layer 70. In other words, the materials that form the absorbent regions serve as a grid or matrix of openings or pores which receive one or more to materials to change from an absorbent state during nonabsorbent state. In either case, the absorbent regions and the nonabsorbent region separating the absorbent regions include at least one same material or thread of material, albeit modified, throughout layer 70 from one absorbent region 80 through the nonabsorbent region to another absorbent region.

As shown by FIG. 1, absorbent region 80B continuously extends in a longitudinal direction from a first axial and to a second axial end of web 50. In one embodiment, nonabsorbent region 82 also continuously extends in a longitudinal direction from one axial and to another axial end of web 50. In the example illustrated in which web 50 is supplied from a supply spool, reel or roll 92 which is taken up by a take-up spool, reel or roll 94, absorbent region 80B and nonabsorbent region 82 continuously extend from one end of the winding to an opposite end of the winding. In one embodiment, absorbent region 80B and nonabsorbent region 82 may alternatively extend substantially from one end to the other end of web 50. Here, the term "substantially" means that minor portions on opposite ends may be composed of other materials and have a sufficient length for securing such opposite ends to the spindles or reels or for adhering the ends of such rolls to themselves. Such minor portions are located and have lengths such they cannot be positioned opposite to print heads 18 for servicing print heads 18 while connected to the spindles of rolls 92 and 94.

Because absorbent region 80B and nonabsorbent region 82 continuously extend substantially from one end of web 50 to another end of web 50, absorbent region 80B is continuously fluidly separated or isolated from region 80A along an entire length of web 50. As a result, any location along the entire length of region 80B may be positioned opposite to print heads 18 without the risk that the particular portion of region 80B will permit receive fluid to undesirably migrate to region 80A. In addition, a greater percentage of region 80B may be used for servicing operations.

As further shown by FIG. 1, in the particular example illustrated, portions of region 80A may be additionally partitioned with nonabsorbent regions 96. Nonabsorbent regions 96 are substantial identical to nonabsorbent region 82 except that nonabsorbent regions 96 transversely extend across layer 70. In particular, regions 96 extend transversely from region 82 to side edge 72 of layer 70. As with region 82, regions 96 extend to surface 78 (shown in FIG. 3) or substantially to surface 78 so as to inhibit or prevent migration of fluid. Regions 96 inhibit migration of fluid from those portions of region 80A which are partitioned from one another. In one embodiment, regions 96 may be spaced from one another by a longitudinal distance slightly larger than the longitudinal length of lift members 58. In operation, web 50 is positioned such that regions 96 are located between wiper members 58. As a result, during wiping, fluid received by one portion of region 80A from one of print heads 18 will not migrate to an adjacent portion of region 80A on an opposite side of a nonabsorbent region 96 which receives fluid from a different one of print heads 18 during wiping. In such an embodiment where different print heads 18 may dispense different types of printing material, such as different colors of ink, regions 96 prevent intermixing of such different colors longitudinally along region 80A.

Although two nonabsorbent regions 96 are shown, web 50 may alternatively include a greater or fewer of such regions 96. In some embodiments, regions 96 may alternatively separate larger portions of region 80A which may encompass more than one web backer 58. In other embodiments, region 80A may be provided with nonabsorbent regions 96. In yet other embodiments, regions 96 may be omitted.

According to one example embodiment, web 50 comprises a webbing of Evolon 100 commercially available from Freudenberg Group of Germany, wherein the webbing is treated to form a nonabsorbent region 82 (and potentially nonabsorbent regions 96). In one embodiment, web 50 has a thickness T of between about 0.27 mm and about 0.50 mm, and nominally about 0.48 mm. Web 50 has a density of approximately 100 g per square meter. In one embodiment, nonabsorbent regions 82 are formed by ultrasonic welding. In one embodiment, nonabsorbent regions 82 and 96 each have a width W of between about 5 mm and about 2.5 mm, and nominally about 1 mm. In other embodiments, web 50 may be formed from other materials and may have other thicknesses. In other embodiments, nonabsorbent regions 82 may have other thicknesses depending upon such factors as the viscosity of the fluid being received by web 50 as well as the materials of web 50.

Figure 4:
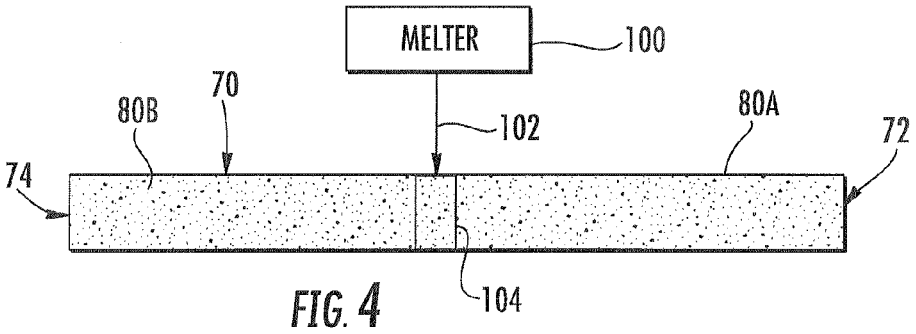
FIG. 4 is a sectional view of a web of the printing system of FIG. 1 illustrating a method for forming a nonabsorbent region according to an example embodiment.
Figure 5:
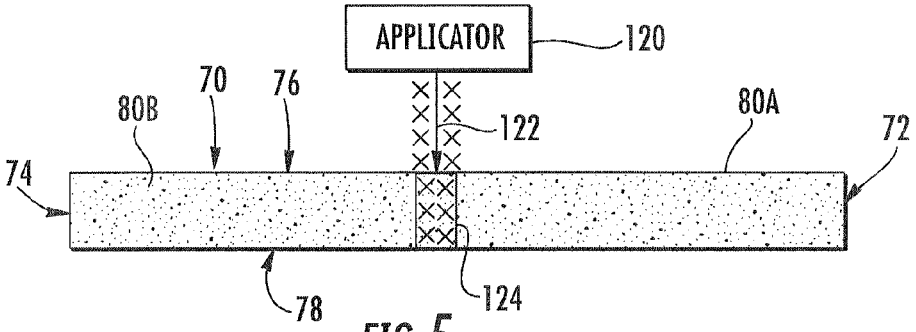
FIG. 5 is a sectional view of the web of the printing system of FIG. 1 illustrating another method for forming a nonabsorbent region according to an example embodiment.

FIGS. 4 and 5 illustrate methods for forming web 50. In the example shown in FIG. 4, layer 70 is provided without nonabsorbent region 82. As such, the entirety of layer 70 is comprised of one or more fluid absorbing materials such as one or more fibers or fabrics. In the example illustrated, layer 70 is formed from one or more fabrics or fibers configured to be melted or burnt, wherein such melting or burning causes the one or more materials to become nonabsorbent. As shown by FIG. 4, a melter 100 applies energy 102 to the one or more materials of layer 70 so as to melt or burn (sinter) portion 104 of layer 70 to form a non-assortment region 82 (shown in FIG. 3). In one embodiment, melter 100 applies heat to fuse or melt the one or more materials of layer 70 at portion 104. In one embodiment, melter 100 ultrasonically welds the one or more materials of layer 72 for nonabsorbent region 82. In one embodiment, such ultrasonic welding may be performed on a layer 70 comprising Evolon 100, commercially available from Freudenberg Group of Germany.

In the example shown in FIG. 5, nonabsorbent region 82 (shown in FIG. 3) is formed in a different manner. As with the method shown in FIG. 4, layer 70 is provided without nonabsorbent region 82. As such, the entirety of layer 70 is comprised of one or more fluid absorbing materials such as one or more fibers or fabrics. In the example illustrated, layer 70 is formed from one or more fabrics, fibers or other porous or absorbent material.

As shown by FIG. 5, an applicator 120 applies a treatment material or fluid 122 to portion 124 of layer 70. The treatment material or fluid 122 interacts with the materials of layer 70 at portion 124 such that the materials of layer 70 become non-absorbent at portion 124 to form nonabsorbent region 82 (shown in FIG. 3). In one embodiment, the treatment material 122 comprises a material configured to chemically interact k with the one or more materials of layer 70 at portion 124 to change such materials from an absorbent state to nonabsorbent state. For example, in one embodiment, treatment materials 122 may chemically react with the materials of layer 70 to melt, fuse or even burn such materials such that the materials change from an absorbent state to a nonabsorbent state. In other embodiments, the materials 122 may be configured to react with the materials of layer 70 to form a new chemical compound or structure which is less absorbent.

In yet other embodiments, material 122 may not chemically alter the one or more materials of layer 70 but instead may itself comprise a fluid, which upon filling in the pores, voids or spaces of the absorbent materials of layer 70, solidifies to form a nonabsorbent region 82. For example, one embodiment, material 122 may comprise a glue, adhesive or epoxy having a sufficiently low viscosity such that it may penetrate layer 70 and be absorbed by layer 70 at portion 124. Upon curing or solidification, the fluid forms a wall to impede or block migration of fluid across the formed nonabsorbent region 82. In one embodiment, the glue, adhesive, epoxy or other fluid material 122 is configured to be substantially inert to the fluid to be received by absorbent regions 80 of web 50. In one embodiment, the glue, adhesive, epoxy or other fluid material 122 is configured to be substantially inert to ink, such as die and pigment-based inks used by drop-on-demand inkjet printing systems for printing images upon print media. In other embodiments, nonabsorbent region 82 and nonabsorbent regions 96 may be formed in other fashions.

Figure 6:
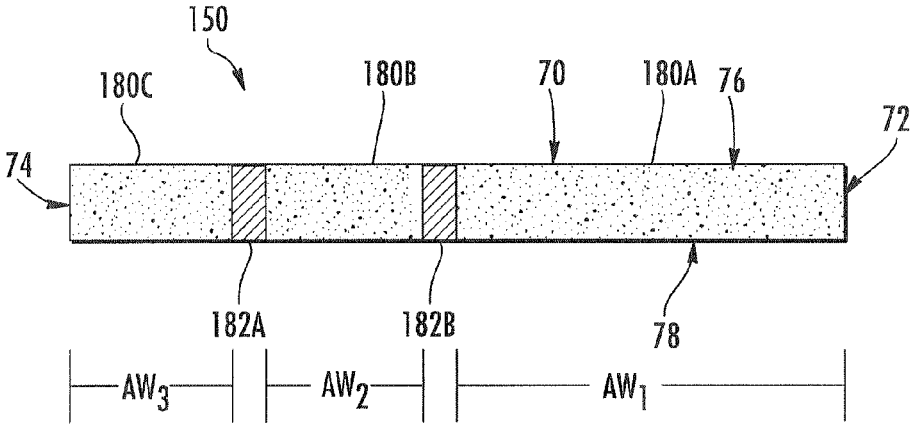
FIG. 6 is a sectional view of another embodiment of the web of FIG. 3 according to an example embodiment.

FIG. 6 illustrates web 150, another embodiment of web 50. Web 150 is configured for use in printing system 10 or other printing systems, wherein servicing of print heads is performed. Web 150 is similar to web 50 except that web 150 includes multiple substantially parallel nonabsorbent regions 182A and 182B (collectively referred to as nonabsorbent regions 182). Those remaining elements of web 150 which correspond to the elements of web 50 are numbered similarly.

Nonabsorbent regions 182 are substantial identical to nonabsorbent region 82 and may be formed by Nan the above described method for forming nonabsorbent region 82. Nonabsorbent reduced 182 partition or divide layer 70 into absorbent regions 180A, 180B and 180C (collectively referred to as absorbent regions 180). As shown by FIG. 6, absorbent region 180A is larger than absorbent regions 180B and 180C. In the example illustrated, absorbent regions number 180B and 180C are similarly sized. Because absorbent regions are 180 may be provided with customized widths AW, regions 180 may provide with different fluid absorption capacities. In one embodiment, web 150 may be provided with a number of regions 180 which exceeds the number of differing servicing operations to be performed on print heads 18. For example, in one embodiment, wiping end spitting/purging operations are performed upon print heads 18. As a result, region 180A may be used for wiping while region number 180B may be used for spitting. Once region number 180B becomes sufficiently saturated with fluid such that its absorption capacity has been consumed, the use of web 150 may continue with such spitting now being performed using region 180C instead of region number 180B.

In other embodiments, the fluid absorption capacities of different regions 180 may be different so as to accommodate different print heads. For example, one embodiment, it may be anticipated at one print head 18 will undergo servicing operations much more frequently as compared to another print head 18 or may eject a greater amount of fluid as compared to another print head 18. In such embodiments, web 150 may be differently partitioned into absorbent regions and web 150 may be appropriately positioned with respect to print heads 18 during servicing such that regions 180 having greater absorption capacities are positioned opposite to those print heads 18 expected to place greater absorption demands upon web 150. In some embodiments, nonabsorbent regions 96 (shown in FIG. 1) may be similarly customized to accommodate more demanding print heads 18.

Figure 7:
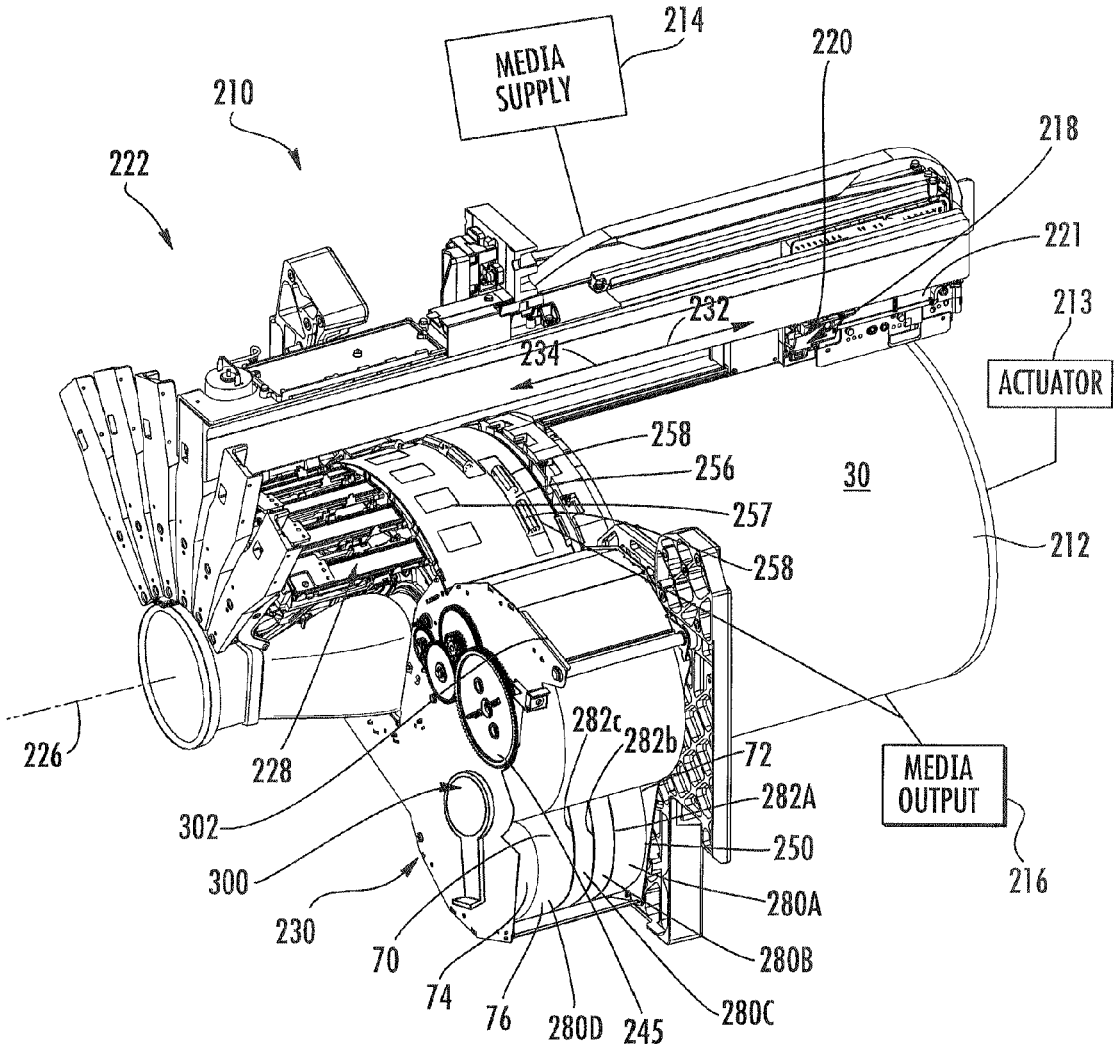
FIG. 7 is a top perspective view of another embodiment of the printing system of FIG. 1 according to an example embodiment.
Figure 8:
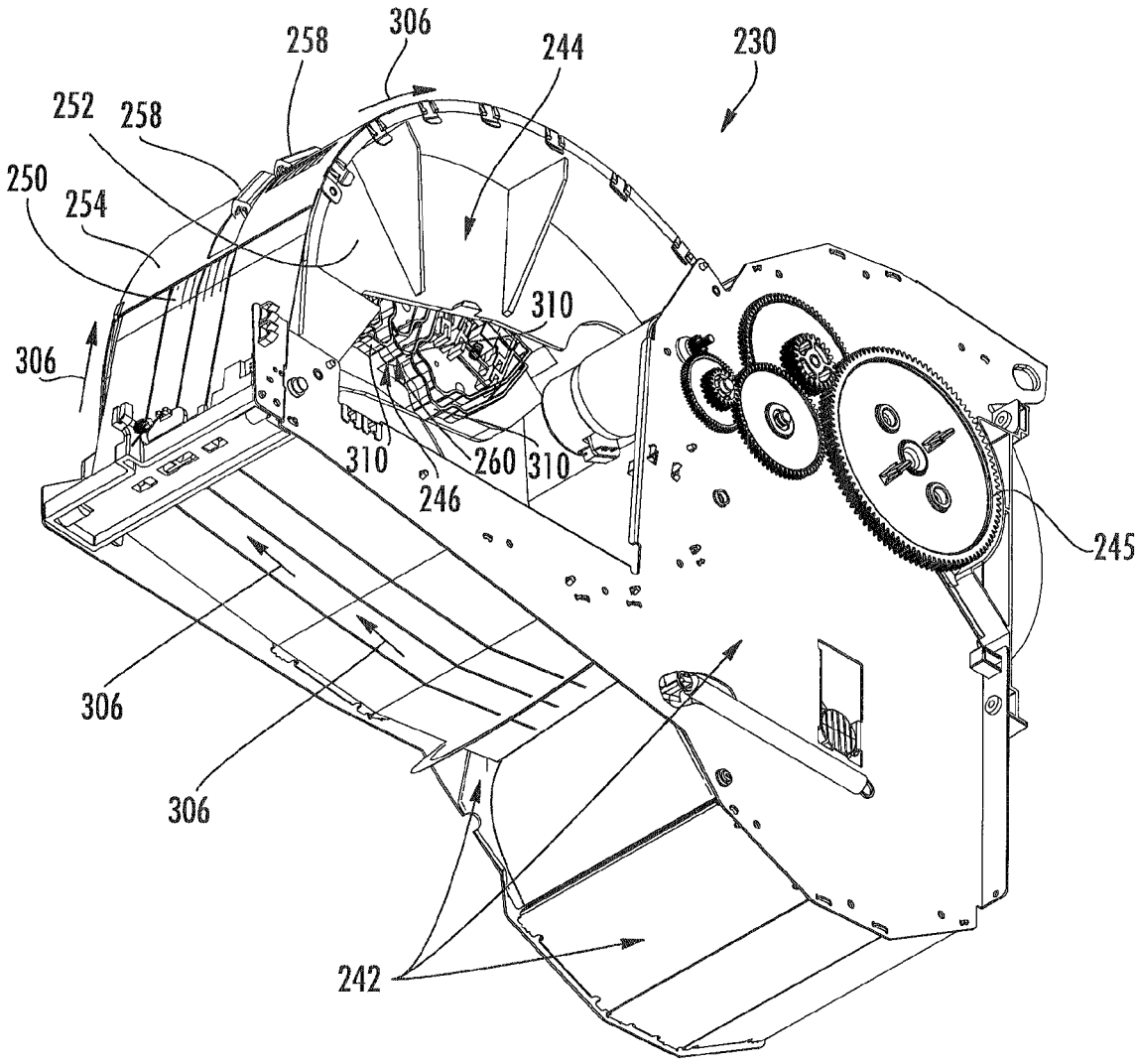
FIG. 8 is a bottom perspective view of a web module of the printing system of FIG. 7 according to an example embodiment.
Figure 9:
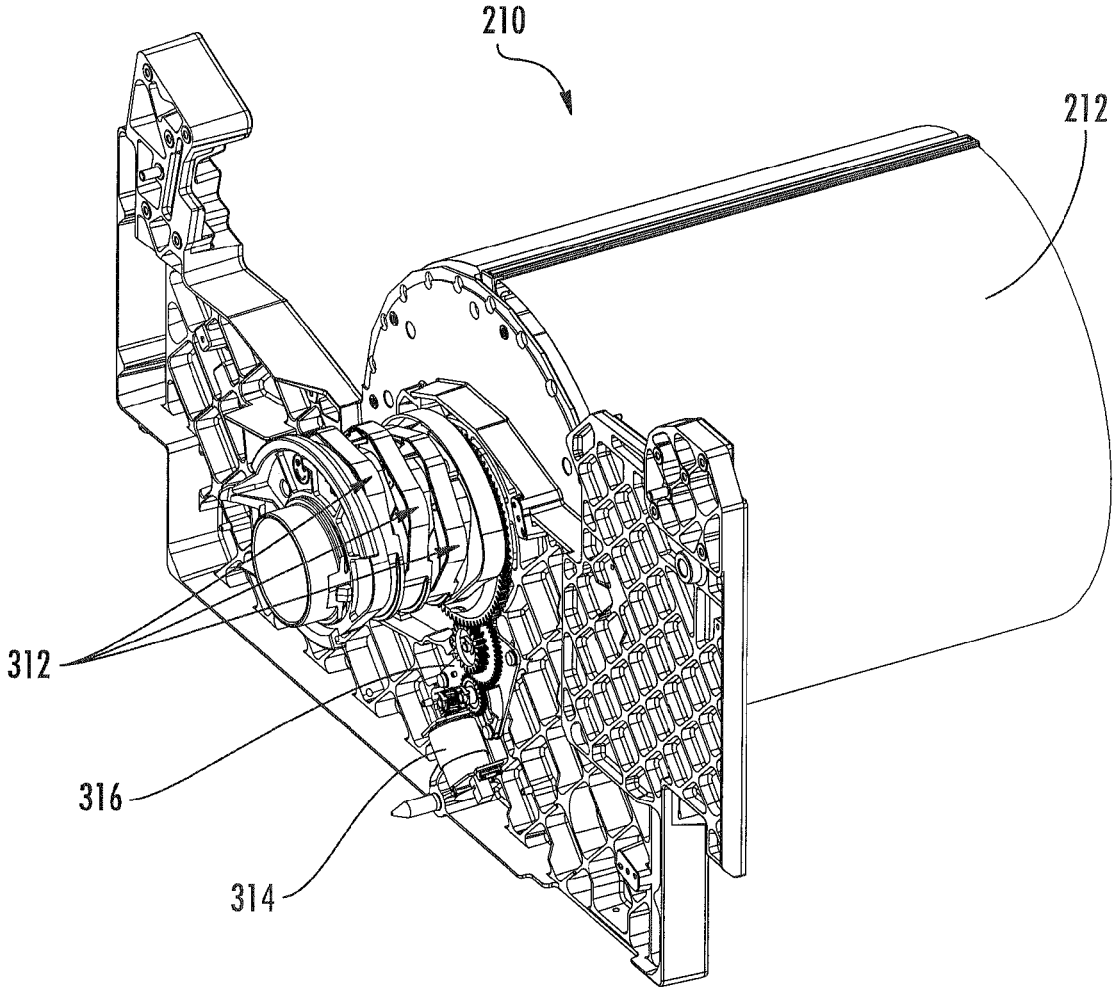
FIG. 9 is a top perspective view of a portion of the printing system of FIG. 7 illustrating actuators for web backers according to an example embodiment.

FIGS. 7-9 illustrate printing system 210, another embodiment of printing system 10 shown in FIG. 1. Printing system 210 generally includes drum 212, rotary actuator 213, media supply 214, media output 216, print heads 218 (one of which is shown), carriages 220 (one of which is shown), actuators 221 (one of which is shown) and service station 222. Drum 212 generally comprises an elongated cylinder configured to be rotatably driven about axis 226 by rotary actuator 213 while transporting media, such as paper, about axis 226 relative to print heads 218. Rotary actuator 213, schematically shown, comprises a source of torque, such as a motor, operably coupled to drum 212 by a transmission (not shown).

Media supply 214, schematically shown, comprises a mechanism configured to supply media to drum 212. In one embodiment, media supply 214 comprises a mechanism configured to pick an individual sheet of media from a stack of media and to supply the individual sheet to drum 212 such that the sheet is wrapped at least partially about drum 212. Media output 216, schematically shown, comprises a mechanism to withdraw printed upon media from drum 212 and to transport withdrawn media to and contain withdrawn media within an output tray, bin or the like.

Print heads 218 comprise print heads configured to dispense imaging material, such as ink, upon the medium held by drum 212. In one embodiment, print heads 218 comprise piezo electric print heads. In another embodiment, print heads 218 comprise thermal inkjet print heads. Print heads 218 are arranged in an arc about axis 226. As a result, print heads 218 are configured to print across a larger area of the media supported by drum 212. In the particular embodiment, drum 212 has an outer surface 230 also arranged in an arc about axis 226. Print heads 218 are arranged in an arc substantially identical to the arc in which surface 230 extends.

Carriage 220 comprises one or more structures configured to support print heads 218 in the arcuate arrangement. In addition, carriage 220 is configured to movably support print heads 218 along axis 226. Actuator 221 comprises a linear actuator configured to move carriage 220 and print heads 218 in the directions indicated by arrows 232, 234 so as to selectively position print heads 218 opposite to the media held by drum 212 or opposite to service station 222. In one embodiment, actuator 221 may comprise a motor (not shown) configured to drive a toothed pulley in engagement with a toothed belt coupled to carriage 220. In another embodiment, actuator 221 may comprise other forms of a linear actuator using rack and pinion arrangements, hydraulic, pneumatic or electrical means. Although only one print head 218, carriage 220 and actuator 221 is shown, in the example illustrated, system 210 includes 6 print heads supported by a 6 carriages, wherein each print head 218 is independently moved or actuated by a dedicated actuator 221. In other embodiments, system 210 may alternatively include a greater or fewer of such print heads 218 supported by one or more carriages 220 and driven by one or more actuators 221.

Service station 222 comprises a station located on an axial end of drum 212 such that carriages 220 may position print heads 218 opposite, or adjacent, to station 222. Station 222 includes one or more components configured to perform servicing operations upon one or more of the print heads 218. As shown by FIG. 8, in the particular example shown, service station 222 includes cappers 228 and web module 230. Cappers 228 comprise structures configured to engage and seal about print heads 218. Cappers 228 reduce drying of fluid within the nozzle of print heads 218 and inhibit contaminants from entering nozzles of print heads 218 when not in use. In some embodiments, cappers 220 may additionally be configured to receive fluid purged from print heads 218.

Web module 230 comprises a module of components which are connected or supported as a single unit and which are removably attached to the remainder of printing system 210. As shown by FIG. 8, web module 230 includes web housing 242, web track 244, web drive 245, lifters 246 and web 250. Housing 242 comprises one or more walls, panels, structures and the like configured to support track 244 and web 38 relative to drum 12. As shown by FIG. 7, housing 42 includes a supply spool 300 and a take-up spool 302 which supply clean web 250 and take-up consumed web 250, respectively. In one embodiment, web housing 242 movably supports web module 230 relative to drum 212. In another embodiment, web module 230 may be stationary with respect to drum 212.

As shown by FIG. 8, track 244 comprises one or more structures configured to support web 250 in an arc about axis 226. In the particular example shown, track 244 is configured to support web 250 about an arc substantially similar to the arc along which print heads 218 are arranged. In the example illustrated, track 244 includes web guide 252 and web cover 254. Web guide 252 comprises an elongate arcuate panel or surface underlying web 250. In yet another embodiment, guide 252 comprises multiple individual surfaces that are spaced from one another in an arc. For example, in one embodiment, guide 252 may be formed from multiple rollers extending in the arc.

Web cover 254 extends over web 250 so as to sandwich and contain web 250. As shown by FIG. 7, web cover 252 includes windows 256, 257 which expose portions of web 250. In particular, windows 256 expose those portions of web 250 opposite to web backers 258. In the example illustrated, web cover 252 includes three such windows 256, wherein each window 256 exposes two web backers 258 for performing wiping operations on two of print heads 218.

Windows 257 expose those portions of web 250 which are to receive fluid ejected or spit from print heads 218. In the example illustrated, web cover 254 includes a separate window arcuately arranged about axis 226 for each of print heads 218. In other embodiments, window 256 may comprise a continuous window through which fluid from more than one print head 218 may be ejected onto web 250. In other embodiments, web cover 254 may have other configurations or may be omitted.

Web drive 245 comprise mechanism configured to drive one or both of supply spool 300 or take-up spool 302 so as to move web 250 across track 244 and across windows 250 6, 257. Web drive 245 drives web 250 over web backers 258. In the example illustrated, web drive 245 comprises a transmission, such as the set of drive gear shown, connected to the take-up spool 302 and operably coupled to a motor. Torque supplied by the motor drives take-up spool 300 to pull web 250 from supply roll 300 about track 244 to take-up spool 302 as indicated by arrows 306 in FIG. 8. In other embodiments, web drive 245 may have other configurations.

Lifters 246 comprise mechanisms configured to lift or elevate selected portions of web 250 and to press or hold such elevated portions of web 250 against opposite portions of print heads 218 to facilitate wiping of print heads 218. In the example illustrated, each of lifters 246 includes a web backer 258 and an actuator 260. Web backer 258 comprises a structure configured to move between (1) a raised position in which web backer 258 contacts and underside of web 250 and lifts the opposing portion of web 250 to a height sufficient to contact and associated opposing print head 218 and (2) a lowered position in which web 250 is spaced from print heads 218. In one embodiment, in a raised position, web backer 258 supports web 250 above track 244 and in the lowered position allows web 250 to rest upon track 244.

Actuators 260 comprise mechanisms configured to selectively move web backers 258 between the raised and lowered positions. As shown by FIG. 8, each actuator 260 includes a cam follower 310 operably coupled to an associated web backer 258. As shown by FIG. 9, each actuator 260 further includes a lift cam 312. Lift cams 312 are operably coupled to a drive motor 314 by a transmission 316. Selective rotation of cams 312 by motor 314 raises and lowers backers 258 between the raised and lowered positions.

In another embodiment, actuator 260 may comprise electric solenoids, pneumatic or hydraulic cylinder assemblies or other actuation mechanisms which directly interact with web backers 258 or which drive in intermediate cam which facilitates movement of web backer 258. In other embodiments where other mechanisms are provided for wiping of print heads 218 and where web 250 is merely used to receive fluid ejected from print heads 218, such as during spitting or purging operations, lifters 246 may be omitted.

Web 250 comprises a band or span of material for performing servicing operations upon print heads 218. In one embodiment, web is configured to interact with print heads 218 by receiving fluid, printing material or ink discharged from print heads 218. For example, in one embodiment, print heads 218 include multiple nozzles. Web 250 facilitates spitting of ink from the nozzles to clear such nozzles. In the embodiment illustrated, web 250 comprises a web of material configured to physically contact the surfaces of print heads 218 so as to wipe print heads 218. In the particular example illustrated, web 250 is also configured to contact the surfaces of print heads 218 as carriage 220 moves print heads 218 along axis 226 relative to web 250 to wipe print heads 218. In other embodiments, web 250 may additionally be configured to be moved relative to print heads 218 to perform such wiping operations. In one embodiment, web 250 comprises a web of fluid absorbent material. In one embodiment, web 250 comprises a fabric material. According to one embodiment, web 250 is formed from a fabric material such as Evolon 100 commercially available from Freudenberg Group of Germany.

As shown by FIG. 7, web 250 is similar to web 50 (shown and described with respect to FIGS. 1 and 3) except that web 250 includes four absorbent regions 280A, 280B, 280C and 280D (collectively referred to as absorbent regions 280), separated by nonabsorbent regions 282A, 282B and 282C (collectively referred to as nonabsorbent regions 282). In the example illustrated, separate absorbent regions 280 are provided for each of the three windows 256. A fourth absorbent region is provided for windows 257.

As with web 50, web 250 is formed from one or more layers, wherein at least a top layer of web 250 is integrally formed as a single unitary body. Because web 250 has a top layer which is integrally formed as a single unitary body, web 250 is less likely to separate when placed in tension. As with web 50, web 250 is formed from a single layer of material integrally formed as a single unitary body. Web 250 comprises a single surface layer 70 which is integrally formed as a single unitary body and integrally extends between opposite transverse edges 72 and 74. Because web 50 is formed from a single layer which is integral from side edge 72 to side edge 74 and which is also integral from a top surface 76 to a bottom surface 78 (shown in FIG. 3), web 250 avoids delamination issues between multiple layers. Consequently, web 250 has greater integrity.

Because web 250 is formed from a single layer 70, web 250 may have a reduced thickness while still having sufficient absorbent capabilities. Because web 250 has a reduced thickness, a roll may be provided with a greater number of windings of web 250 occupying the same volume or space. As a result, a larger number of servicing operations may be performed with web 250 without consumption and replacement of web 250. In other embodiments, web 250 may alternatively include multiple layers, wherein the topmost layer is integrally formed as a single unitary body and extends from side edge 72 to side edge 74.

Like absorbent regions 80 (shown a FIG. 3), absorbent regions 280 are separated or fluidly insulated or isolated from one another by nonabsorbent region 282. Absorbent regions 280 comprise portions of layer 70 which are configured to absorb fluid or, alternatively, wick fluid away from top surface 76. In one embodiment, absorbent regions 280 comprise one or more fabric materials configured to absorb or retain fluid, such as ink. In another embodiment, absorbent regions 280 comprise one or more porous or capillary materials configured to absorb or retain fluid. In the example illustrated, regions 280 are formed from substantially identical homogenous mixtures of fabric, fibers or other absorbent material such that regions 280 at substantially similar absorbent properties. In such an embodiment, fabrication of web 250 is simplified.

In other embodiments, although still integral with one another, regions 280 may alternatively have different blends of fibers or fabric materials providing regions 280 with different absorption properties. For example, in one embodiment, one of regions 280 may be located to form a first servicing operation all in other regions 280 is configure to perform another distinct servicing operation upon print heads 218. In such an embodiment, regions may of different blends or compositions. In one embodiment, one of regions 280 may have a blend or composition ideally suited for wiping print heads 218, such as being softer, while the other of regions 280 may have a blend or composition ideally suited for overall absorption and retention, more suitable for retaining fluid purged or spit from print heads 218.

In still other embodiments, one or more of regions 280, while still being integral, may have different compositions or different densities between surfaces 76 and 78 (shown in FIG. 3). In some embodiments, portions of layer 70 proximate to surface 78 may have a different density or composition as compared to portions of layer 270 proximate to surface 76. For example, in some embodiments, a lower portion of layer 70 of web 250 may have a greater density or a different blend of fabric or fibers as compared to an upper portion of layer 70 of web 250. In one embodiment, the lower portion may have a greater density, increasing its fluid containing capacity as compared to the upper portion. In such an embodiment, this may facilitate wicking of fluid away from surface 76 and retention of such fluid away from surface 76. In another embodiment, layer 70 of web 250 may be provided with a gradually changing blend or composition or additional different portions between surfaces 76 and 78 (shown in FIG. 3). In other embodiments, layer 70 may be homogenous from surface 76 to surface 78.

Nonabsorbent regions 282 extend between absorbent regions 280. Nonabsorbent regions 282 form walls substantially impervious to fluid flow or fluid migration. As a result, nonabsorbent regions 282 inhibit or even prevent fluid migration from one region 280 to another region 280. In the example illustrated, nonabsorbent regions 282 extend substantially from top surface 76 to bottom surface 78 (shown in 3) of layer 70 of web 250 to inhibit any migration between regions 280. In another embodiment, nonabsorbent regions 82 may alternatively extend from top surface 76 to a depth sufficiently close to bottom portion 78 such that migration is inhibited or prevented or such that any fluid that does migrate from one region 280 to another region 280 remains retained or contained within the migrated to region proximate to surface 78 without migrating to surface 76.

Nonabsorbent regions 82 are integral with absorbent regions 280. As shown by FIG. 7, absorbent regions 280 continuously extend in a longitudinal direction from a first axial and to a second axial and of web 250. In one embodiment, nonabsorbent regions 282 also continuously extend in a longitudinal direction from one axial end to another axial end of web 250. In the example illustrated in which web 250 is supplied from a supply reel, roll or spool 300 which is taken up by a take-up reel, roll or spool 302, absorbent regions 280 and nonabsorbent regions 282 continuously extend from one end of the winding to an opposite end of the winding. In one embodiment, regions 280 and 282 may alternatively extend substantially from one end to the other end of web 250. Here, the term "substantially" means that minor portions on opposite ends may be composed of other materials and have a sufficient length for securing such opposite ends to the spindles or reels or for adhering the ends of such rolls to themselves. Such minor portions are located and have lengths such they cannot be positioned opposite to print heads 218 for servicing print heads 218 while connected to the spindles of rolls or spools 300, 302.

Because regions 280 and 282 continuously extend substantially from one end of web 250 to another end of web 250, absorbent regions 280 are continuously fluidly separated or isolated from one another along an entire length of web 250. As a result, any location along the entire length of regions 280 may be positioned opposite to print heads 218 without the risk that the particular portion of a region 280 will permit fluid to undesirably migrate to an adjacent region 280. In addition, a greater percentage of each of regions 280 may be used for servicing operations.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a web having a surface layer integrally extending between opposite transverse edges, the surface layer including absorbent regions separated by at least one nonabsorbent region;

further comprising a roll of the web and a print head having nozzles opposite to the absorbent regions.

2. The apparatus of claim 1, wherein the absorbent regions continuously extend in a longitudinal direction from a first end to a second end of the web.

3. The apparatus of claim 1, wherein the non-absorbent regions comprise melted portions.

4. The apparatus of claim 1, wherein the absorbent regions comprise fabric.

5. The apparatus of claim 1, wherein the at least one non-absorbent region comprises absorbent material filled with a nonabsorbent material.

6. The apparatus of claim 1, wherein the web has a thickness of less than or equal to about 0.5 millimeters.

7. The apparatus of claim 1, wherein the surface layer is formed by a layer of absorbent material heading regions of the absorbent material melted from a top to a bottom of the layer.

8. The apparatus of claim 1 further comprising one or more print heads having a first set of nozzles configured to eject a first fluid and a second set of nozzles configured to eject a second distinct fluid, wherein the web is configured to be moved across the first set of nozzles and the second set of nozzles with the at least one non-absorbent region extending between the first set of nozzles and the second set of nozzles.

9. An inkjet printer comprising:

one or more inkjet printheads having a first set of nozzles and a second set of nozzles;

a web having a surface layer integrally extending between opposite transverse edges, the surface layer including a first absorbent region and a second absorbent region separated by a nonabsorbent region, wherein the nonabsorbent region is positioned between the first set of nozzles and the second set of nozzles and further comprising a roll of the web.

10. The inkjet printer of claim 9, wherein the absorbent regions continuously extend in a longitudinal direction from a first end to a second end of the web.

11. The inkjet printer of claim 9, wherein the non-absorbent regions comprise melted portions.

12. The inkjet printer of claim 9, wherein the absorbent regions comprise fabric.

13. The inkjet printer of claim 9, wherein the at least one nonabsorbent region comprises absorbent material filled with a nonabsorbent material.

14. The inkjet printer of claim 9, wherein the web has a thickness of less than or equal to about 0.5 millimeters.

15. A method comprising:

providing a web having a surface layer integrally extending between opposite transverse edges, the surface layer including a first absorbent region and a second absorbent region separated by a nonabsorbent region; and positioning the nonabsorbent region between a first set of nozzles and a second set of nozzles; and where the web is part of a supply roll, the method comprising unwinding the supply roll.

16. The method of claim 15 further comprising:

contacting the first set of nozzles with the first absorbent region; and ejecting fluid onto the second absorbent region from the second set of nozzles while the second set of nozzles are spaced from the second absorbent region.

* * * * *

UNITED STATES PATENT AND TRADEMARK OFFICE

CERTIFICATE OF CORRECTION

PATENT NO. : 7,988,256 B2
APPLICATION NO. : 12/200927
DATED : August 2, 2011
INVENTOR(S) : Tanya V. Burmeister et al.

It is certified that error appears in the above-identified patent and that said Letters Patent is hereby corrected as shown below:

Title page, Item (75), Inventors, delete "Tanya W. Burmeister," and insert -- Tanya V. Burmeister, --, therefor.

Signed and Sealed this
Twenty-first Day of August, 2012

David J. Kappos

David J. Kappos
*Director of the United States Patent and Trademark Office*